US006530318B1

(12) United States Patent
Yamamoto et al.

(10) Patent No.: US 6,530,318 B1
(45) Date of Patent: Mar. 11, 2003

(54) STENCIL PRINTING SYSTEM USING UV-CURABLE INK AND HAVING INK SUPPLY ROLL COMPRISED OF NONMETALLIC MATERIAL

(75) Inventors: Yasuo Yamamoto, Amimachi (JP); Toshihiro Endo, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/665,167

(22) Filed: Sep. 19, 2000

(30) Foreign Application Priority Data

Sep. 22, 1999 (JP) ..... 11-269083

(51) Int. Cl.[7] ..... B41L 13/18; B41L 13/04

(52) U.S. Cl. ..... 101/120; 101/119; 101/116; 492/59

(58) Field of Search ..... 101/114, 116, 101/119, 120, 124, 348, 351.7; 492/46, 48, 53, 56, 57, 59

(56) References Cited

U.S. PATENT DOCUMENTS

| | | | | |
|---|---|---|---|---|
| 5,113,760 A | | 5/1992 | Sonobe et al. | 101/348 |
| 5,445,588 A | * | 8/1995 | Ishibashi et al. | 492/31 |
| 5,510,141 A | * | 4/1996 | Makita et al. | 427/165 |
| 5,845,571 A | * | 12/1998 | Kurashige et al. | 101/118 |
| 5,950,533 A | * | 9/1999 | Kildune et al. | 101/23 |

FOREIGN PATENT DOCUMENTS

| | | |
|---|---|---|
| EP | 0 662 394 | 7/1995 |
| JP | 04-185458 | 7/1992 |

* cited by examiner

*Primary Examiner*—Leslie J. Evanisko
(74) *Attorney, Agent, or Firm*—Nixon Peabody LLP; Donald R. Studebaker

(57) ABSTRACT

An ink supply roll is disposed inside a printing drum of a stencil printer and supplies ink to the inner peripheral surface of the printing drum. At least the surface layer of the ink supply roll is formed of a nonmetal material which is not larger than 100° in contact angle and not larger than ±5% in swelling ratio to an ultraviolet-curing monomer.

9 Claims, 2 Drawing Sheets

STENCIL PRINTING SYSTEM USING UV-CURABLE INK AND HAVING INK SUPPLY ROLL COMPRISED OF NONMETALLIC MATERIAL

BACKGROUND OF THE INVENTION

1. Field of the Invention

This invention relates to an ink supply roll for a stencil printer.

2. Description of the Related Art

There have been known an outer press type stencil printer and an inner press type stencil printer. The outer press type stencil printer comprises a printing drum around which a stencil is wound, a squeegee roll which supplies ink to the inner peripheral surface of the printing drum, and an outer press roll which presses a printing paper against the outer peripheral surface of the printing drum with the stencil intervening therebetween.

The inner press type comprises a cylindrical printing drum having a flexible porous peripheral wall around which a stencil is wound, an ink supply section provided inside the printing drum, a back press roll provided at a predetermined distance from the printing drum to extend in parallel to the printing drum, and an inner press roller which is provided inside the printing drum and is adapted to outwardly deform the flexible peripheral wall of the printing drum to press the peripheral wall and the stencil thereon against the back press roll. In the inner press type stencil printer, a printing paper is fed between the stencil on the deformed peripheral wall of the printing drum and the back press roller when print is made.

In the outer press type stencil printer, ink is supplied to the inner peripheral surface of the printing drum by way of the squeegee roll and in the inner press type stencil printer, ink is supplied to the inner peripheral surface of the printing drum by way of the inner press roll. In this specification, "ink supply roll" means various rolls for supplying ink to the inner peripheral surface of the printing drum including the squeegee roll in the case of the outer press type stencil printer and the inner press roll in the case of the inner press type stencil printer.

In a stencil printer, W/O emulsion ink or oil ink is generally used. Since including pigment, solvent, resin and/or activator, such stencil printer ink is low in both polarity and surface tension. Accordingly, the surface layer of the ink supply roll conventionally has been formed of metal or rubber. For ink which is especially low in polarity, a material which is good in wetting, e.g., metal high in surface polarity or rubber, is selected. When rubber is selected, the rubber should be low in swelling.

Various stencil printing inks have been developed according to the needs and progress of printing technique. For example, ultraviolet curing ink has been attracting attention in that since it is cured upon exposure to ultraviolet rays and instantaneously dries, it can contribute to rationalization of the printing process, is free from air pollution by solvent or the like, and can produce film which is strong and high in wear resistance. However, the ultraviolet curing ink is produced by forming a vehicle by photosensitive oligomer and monomer and adding a photo-initiator to the vehicle and is generally high in viscosity.

Use of the ultraviolet curing ink in the conventional stencil printer gives rise to the following problems due to difference in properties from the oil ink and the like which have been generally used in the stencil printer.

First, since the ultraviolet curing ink is apt to be cured when subjected to large frictional force, there is fear that the ink is cured when it is kept sliding for a long time between metal components in the printing drum. Second, since the ultraviolet curing ink is higher in polarity than the conventional stencil printer ink, the ink can soak into the ink supply roll, when the ink supply roll is formed of rubber which has been conventionally used, and swell the ink supply roll to deteriorate the durability of the ink supply roll and to cause mechanical trouble in the components in contact with the ink supply roll. Third, if the ink supply roll is formed of a rubber material low in polarity in order to prevent swelling of the ink supply roll, wetting of the ink to the ink supply roll becomes poor, which can result in blur in the printed image. This tendency is enhanced as the temperature increases since the viscosity of the ultraviolet curing ink becomes lower at an elevated temperature.

SUMMARY OF THE INVENTION

In view of the foregoing observations and description, the primary object of the present invention is to provide an ink supply roll for a stencil printer which can prevent curing of the ultraviolet curing ink, is less apt to be swelled by the ultraviolet curing ink, is good in wetting to the ultraviolet curing ink, and is high in durability even when it is exposed to the ultraviolet curing ink.

In accordance with the present invention, there is provided an ink supply roll which is disposed inside a printing drum of a stencil printer and supplies ink to the inner peripheral surface of the printing drum, characterized in that at least its surface layer is formed of a nonmetal material which is not larger than 100° in contact angle and not larger than ±5% in swelling ratio to an ultraviolet-curing monomer.

The ink supply roll need not be entirely formed of such a material but has only to be formed of such a material at its surface layer. For example, the ink supply roll may be formed by wrapping a band of such a material around a metal roll. In this case, it is preferred that the band be of a substantial thickness taking into account the durability of the ink supply roll. It is needless to say the ink supply roll may be entirely formed of such a material. In this case, the durability of the ink supply roll can be further enhanced.

The term "contact angle" is generally defined as follows. That is, as shown in FIG. 1, when there exists liquid on the surface of a solid in air, out of the angles between the surface of the solid and a tangent which touches the liquid at the point of contact P where the solid phase, the liquid phase and the air phase are in contact with each other, one including the liquid phase (indicated at θ in FIG. 1) is defined to be the "contact angle". In this specification, the "contact angle" means the contact angle when distilled water at 23° C. is used as the liquid. In accordance with the present invention, the contact angle of the skin material of the ink supply roll should be not larger than 100° and preferably not larger than 98°.

As the material which is not larger than 100° in contact angle, chloroprene rubber, EPDM rubber (copolymer of ethylene, propylene and diene), fluororubber, NBR (70°) (acrylonitrile-butadiene rubber) and the like are preferred.

The swelling ratio is generally defined as a change in volume or mass when rubber or the like absorbs gas or liquid. In this specification, the "swelling ratio" means a change in mass of a material when the material is dipped in ultraviolet curing monomer at 50°C. for one week. That is, that the material is not larger than ±5% in swelling ratio means that the mass of the material after the dipping is in the range of 0.95 to 1.05 when the mass of the material before the dipping is taken as 1. In accordance with the present invention, the swelling ratio of the skin material for the ink supply roll should be not larger than ±5% and preferably not larger than ±3%. The materials which is not larger than ±5% in swelling ratio include chloroprene rubber, EPDM rubber, fluororubber, natural rubber and the like.

Further, the skin material for the ink supply roll of the present invention should be a nonmetal material which is solid at normal temperatures.

In accordance with the present invention, by using a nonmetal material which is not larger than 100° in contact angle and not larger than ±5% in swelling ratio to an ultraviolet-curing monomer as the skin material of the ink supply roll, curing of ink due to sliding friction can be suppressed, wetting of ink to the ink supply roll is improved so that blur of image is suppressed, and swelling of the ink supply roll by the ultraviolet curing ink can be suppressed, whereby durability of the ink supply roll can be ensured.

DETAILED DESCRIPTION OF THE INVENTION

Figure 1:
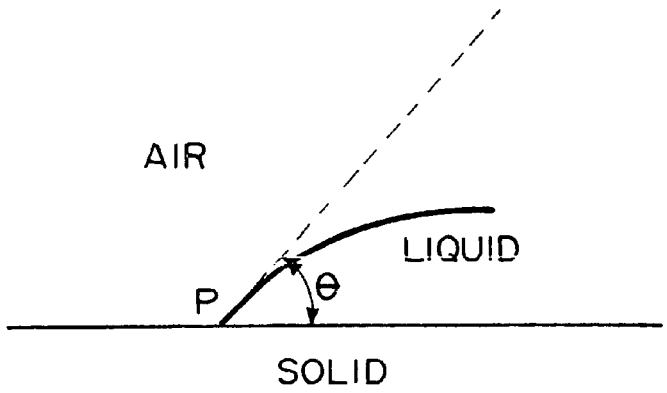
FIG. 1 is a view for illustrating the contact angle.
Figure 2:
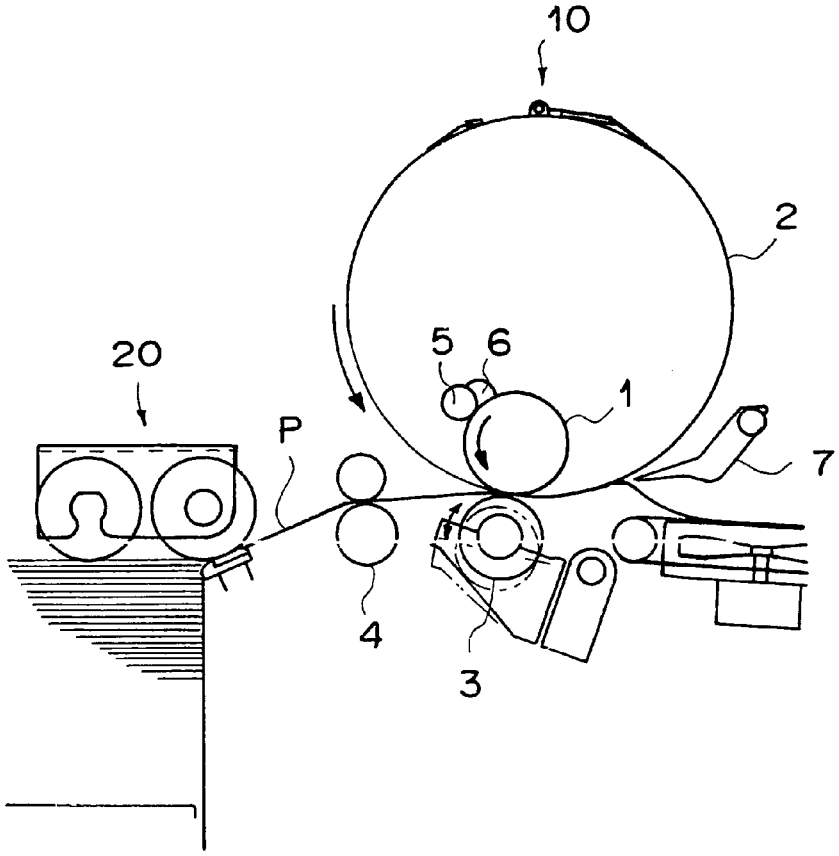
FIG. 2 is a schematic cross-sectional view showing an outer press type stencil printer employing an ink supply roll in accordance with the present invention.

FIG. 2 shows an outer press type stencil printer in which an ink supply roll in accordance with an embodiment of the present invention is employed. The stencil printer 10 comprises a cylindrical printing drum 2 which has a pair of end plates and is rotatable about its longitudinal axis, a squeegee roll 1 provided inside the printing drum 2, a doctor roll 5 disposed near the squeegee roll 1, and an outer press roll 3 which is provided below the printing drum 2 to be movable up and down. The peripheral wall of the printing drum 2 is ink-permeable at a portion corresponding to the printing area and a stencil is wound around the peripheral wall of the printing drum 2.

Operation of the outer press type stencil printer shown in FIG. 2 will be briefly described, hereinbelow. The printing drum 2 is rotated in the counterclockwise direction by a main motor (not shown). Printing papers P are fed one by one from a paper supply section 20 and are inserted into between the printing drum 2 and the outer press roll 3 in a predetermined position relative to the printing drum 2 by a secondary paper supply roll 4. The outer press roll 3 presses the printing paper P against the outer peripheral surface of the printing drum 2 in synchronization with rotation of the printing drum 2, whereby ink is transferred to the printing paper P through the ink-permeable portion of the printing drum 2 and the perforations in the stencil. The doctor roll 5 forms an ink fountain 6 associated with the squeegee roll 1, and ink in the ink fountain 6 is uniformly supplied over the outer peripheral surface of the squeegee roll 1 and functions as a stock for continuously supplying ink to the stencil. The squeegee roll 1 is uniformly coated with ink and, at the same time, receives pressure and/or impact from the outer press roll 3. After printing, the printing paper P is separated from the printing drum 2 by a separator 7.

Figure 3:
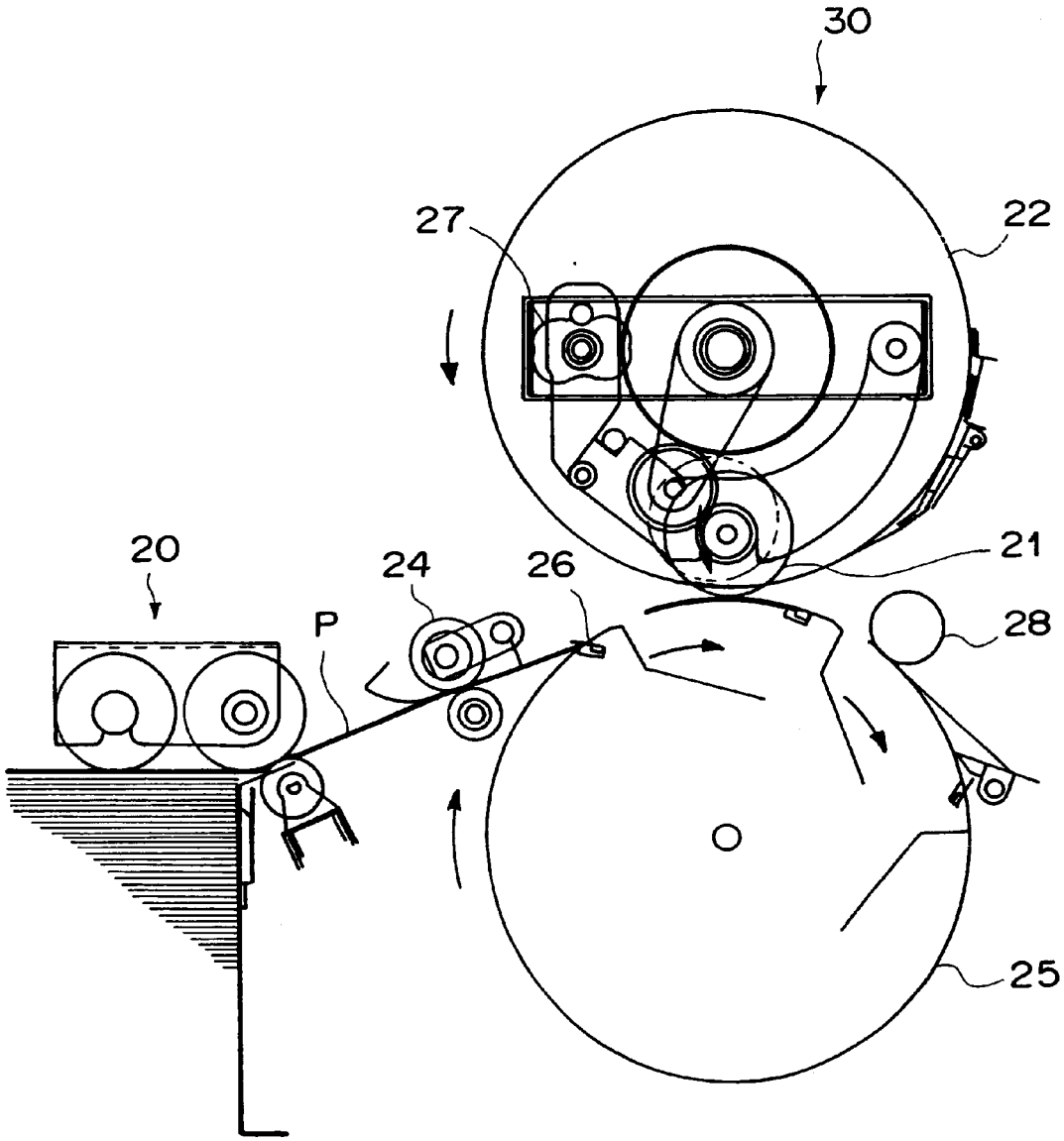
FIG. 3 is a schematic cross-sectional view showing an inner press type stencil printer employing an ink supply roll in accordance with the present invention.

FIG. 3 shows an inner press type stencil printer in which an ink supply roll in accordance with an embodiment of the present invention is employed. The stencil printer 30 shown in FIG. 3 comprises acylindrical printing drum 22 which is rotatable about its longitudinal axis, an inner press roll 21 provided inside the printing drum 22, and a back press roll 25 which is provided below the printing drum 22 to receive the pressure from the printing drum 22. The peripheral wall of the printing drum 22 is formed by a fine mesh screen which can uniformly disperse ink. Since the screen is flexible and its ends are not fixed, the peripheral wall of the printing drum 22 is easily deformed toward the back press roll 25 when the inner press roll 21 is moved toward the back press roll 25 to push the peripheral wall of the printing drum 22 toward the back press roll 25.

Operation of the inner press type stencil printer shown in FIG. 3 will be briefly described, hereinbelow. The printing drum 22 is rotated in the counterclockwise direction by a main motor (not shown). Printing papers P are fed one by one from a paper supply section 20 and are delivered to a sheet gripper 26 on the back press roll 25 by a secondary paper supply roll 24. When it is detected that the printing paper P is delivered to the sheet gripper 26 by the secondary paper supply roll 24, an electromagnetic clutch 27 is actuated to move the inner press roll 21 toward the back press roll 25, whereby the peripheral wall of the printing drum 22 and the stencil wound around the printing drum 22, which are flexible, are deformed outward and pressed against the back press roll 25 in a surface contact with the printing paper P sandwiched between the stencil and the back press roll 25. Ink is transferred to the printing paper P through the peripheral wall of the printing drum 22 and the perforations in the stencil in this state and print is made. After printing, the printing paper P is separated from the printing drum 22 by the sheet gripper 26 releasing the printing paper P and discharge pinch rollers 28 pinching the sides of the printing paper P.

As can be understood from the description above, sliding friction is generated between the squeegee roll 1 and the inner peripheral surface of the printing drum 2 in the case of the outer press type stencil printer and between the inner press roll 21 and the inner peripheral surface of the printing drum 22 in the case of the inner press type stencil printer. Further, sliding friction is generated between opposite ends of the squeegee roll 1 and the end plates of the printing drum 2 and between opposite ends of the inner press roll 21 and the end plates of the printing drum 22. When ink such as ultraviolet curing ink which is high in viscosity and is apt to be cured when subjected to high frictional force is employed, ink is apt to be cured at these parts. In accordance with the present invention, ultraviolet curing ink is prevented from being cured by the sliding friction force by using a nonmetal material which is not larger than 100° in contact angle and not larger than ±5% in swelling ratio to an ultraviolet-curing monomer as a skin material of the ink supply roll (e.g., the squeegee roll in the case of the outer press type stencil printer and the inner press roll in the case of the inner press type stencil printer).

EXAMPLE

Inner press rolls for an inner press type stencil printer were respectively made of chloroprene rubber, EPDM rubber, fluororubber, high-carbon NBR, NBR (70°), natural rubber, aluminum, urethane rubber and silicone rubber. These inner press rolls were incorporated in a stencil printer SR7400 (RISO KAGAKU CORPORATION). Ink was prepared from the following components in a normal method.

- epoxy acrylate oligomer (Harima Chemicals, Inc.) . . . 20 parts
- dipentaerythritol hexaacrylate (Toagosei co., Ltd.) . . . 34 parts
- phenylethylene oxide modified acrylate (Toagosei co., Ltd.) . . . 34 parts furnace black (Mitsubishi Chemical corporation) . . . 4 parts Irgacure 907 (Ciba-Geigy) . . . 3 parts BENTON 38 (RHEOX Inc.) . . . 3 parts Solsperse S24000GR (ZENECA Limited: pigment dispersant) . . . 1 part polymerization inhibitor . . . 0.1 part The swelling ratio of the materials were obtained by dipping the materials in phenoxytetraethylene glycol acrylate (ultraviolet curing monomer) at 50° C. for one week and measuring a change in weight before and after leaving the materials. The contact angle of the materials were measured by a sessile drop method of distilled water by the use of a CA-DT-A model contact angle meter (Kyouwa Interface science co., Ltd.).

The rolls were evaluated on the basis of whether ink was cured, the durability of the rolls and whether blur of image was observed. Whether ink was cured was determined on the basis of whether curing of ink in the printing drum was observed after printing 50000 copies with a non-perforated stencil. The durability of the roll was evaluated on the basis of whether the gap between the inner press roll and the doctor roll was changed from the initial state after letting the roll stand for one week after printing 50000 copies with a non-perforated stencil. The blur of image was evaluated by making print at the highest speed of the stencil printer SR7400 at 35° C. (environmental temperature) with stencil which was perforated according to an original having small point letters and visually observing the degree of blur of letters. The result was as shown in the following table 1.

TABLE 1

| | swelling ratio | contact angle | cure | durability | blur |
|---|---|---|---|---|---|
| chloroprene rubber | 0.95 | 98.0 | ○ | ○ | ○ |
| EPDM rubber | 0.95 | 92.4 | ○ | ○ | ○ |
| fluororubber | 1.05 | 94.0 | ○ | ○ | ○ |
| high-carbon NBR | 1.44 | 102.2 | ○ | X | X |
| NBR (70°) | 1.63 | 83.4 | ○ | X | ○ |
| natural rubber | 0.95 | 112.6 | ○ | ○ | X |
| aluminum | 1.00 | 71.7 | X | ○ | ○ |
| urethane rubber | 1.40 | 80.2 | ○ | X | ○ |
| silicone rubber | 1.01 | 108.6 | ○ | ○ | X |

In table 1;

○ in "cure" means that curing of ink was not observed and x in "cure" means that curing of ink was observed.

○ in "durability" means that the durability was high and x in "durability" means that the durability was low.

○ in "blur" means that no blur was observed and x in "blur" means that blur was observed. The swelling ratio is expressed in terms of relative values when the mass of the roll before dipping is taken as 1.

As can be understood from table 1, in the case of the rolls made of a nonmetal material which was not larger than 100° in contact angle and not larger than ±5% in swelling ratio (chloroprene rubber, EPDM rubber, fluororubber), curing of ink was not observed, durability of the inner press roll was not deteriorated and blur of image was not observed. In the case of the roll made of a material which was larger than 100° in contact angle though not larger than ±5% in swelling ratio (natural rubber, silicon rubber), blur of image was observed due to poor wetting. In the case of the rolls made of a material which was larger than ±5% in swelling ratio though not larger than 100° in contact angle (NBR (70°), urethane rubber), durability of the inner press roll was deteriorated due to swelling. In the case of the roll made of metal (aluminum), curing of ink was observed though aluminum was not larger than ±5% in swelling ratio and not larger than 100° in contact angle.

Thus, by using a nonmetal material which is not larger than 100° in contact angle and not larger than ±5% in swelling ratio to an ultraviolet-curing monomer as the skin material of the ink supply roll, curing of ink due to sliding friction can be suppressed, wetting of ink to the ink supply roll is improved so that blur of image is suppressed, and durability of the ink supply roll can be ensured.

In addition, all of the contents of Japanese Patent Application No. 11(1999)-269083 are incorporated into this specification by reference.

What is claimed is:

1. A stencil printing system comprising:

a printing drum;

an ultraviolet-curing ink comprising an ultraviolet-curing monomer;

an ink supply roll having a surface layer adapted to carry and apply said ultraviolet-curing monomer to the inner peripheral surface of said printing drum, said surface layer being formed of a nonmetal material having a contact angle not larger than 100°, wherein said nonmetal material has a swelling ratio to said ultraviolet-curing monomer of not larger than ±5%.

2. The stencil printing system of claim 1, wherein the contact angle is not larger than 98°.

3. The stencil printing system of claim 1, wherein the swelling ratio to said ultraviolet-curing monomer is not larger than ±3%.

4. A stencil printing system comprising:

a printing drum;

an ultraviolet-curing ink comprising an ultraviolet-curing monomer;

an ink supply roll for supplying said ultraviolet-curing ink comprising said ultraviolet-curing monomer to the inner peripheral surface of said printing drum, said ink supply roll having a surface layer formed of a nonmetal material having a contact angle not larger than 100°, wherein said nonmetal material has a swelling ratio to said ultraviolet-curing monomer of not larger than ±5%.

5. The stencil printing system of claim 4, wherein the contact angle is not larger than 98°.

6. The stencil printing system of claim 4, wherein the swelling ratio to said ultraviolet-curing monomer is not larger than ±3%.

7. A stencil printing system comprising:

a printing drum having an inner peripheral surface; and an ultraviolet-curing ink comprising an ultraviolet-curing monomer; and an ink supply roll disposed inside said printing drum for supplying said ultraviolet-curing ink comprising said ultraviolet-curing monomer to the inner peripheral surface of said printing drum, said ink supply roll having a surface layer being formed of a nonmetal material having a contact angle not larger than 100°, wherein said nonmetal material has a swelling ratio to said ultraviolet-curing monomer of not larger than ±5%.

8. The stencil printing system of claim 7, wherein the contact angle is not larger than 98°.

9. The stencil printing system of claim 7, wherein the swelling ratio to said ultraviolet-curing monomer is not larger than ±3%.

* * * * *